United States Patent [19]

Schleis

[11] 4,024,957

[45] May 24, 1977

[54] CRANE WITH FOLDABLE BOOM

[75] Inventor: Jerome J. Schleis, Denmark, Wis.

[73] Assignee: Northwest Engineering Company, Green Bay, Wis.

[22] Filed: July 25, 1975

[21] Appl. No.: 599,167

[52] U.S. Cl. ..... 212/144; 212/59 R

[51] Int. Cl.[2] ..... B66C 23/62

[58] Field of Search ..... 254/139.1; 52/111, 112, 52/113, 114, 115, 116, 641, 645, 646; 212/144, 46, 58, 59

[56] References Cited

UNITED STATES PATENTS

| | | | |
|---|---|---|---|
| 2,176,731 | 10/1939 | Claire | 52/117 |
| 2,689,656 | 9/1954 | Przybylski | 212/144 |
| 3,034,660 | 5/1962 | Rau et al. | 212/46 R |

FOREIGN PATENTS OR APPLICATIONS

| | | | |
|---|---|---|---|
| 301,039 | 5/1968 | Sweden | 212/144 |
| 971,103 | 9/1964 | United Kingdom | 212/46 B |

*Primary Examiner*—Lawrence J. Oresky
*Attorney, Agent, or Firm*—Andrus. Sceales, Starke & Sawall

[57] ABSTRACT

A carrier-mounted crane is provided with inner and outer boom sections which are securable together at upper and lower connections. When the outer boom is to be pivotally folded beneath the inner boom, the lower connection comprises a folding compound arm extending between the boom sections and pivotable intermediate its ends. When the upper boom connection is released and the outer boom folded under, its main pivot connection to the compound arm shifts longitudinally away from the inner boom section, thus effectively moving the outer boom away from the carrier. The tip or outer end of the folded outer boom will thereby remain free of interference with the carrier elements.

7 Claims, 8 Drawing Figures

FORWARD
REARWARD

CRANE WITH FOLDABLE BOOM

BACKGROUND AND SUMMARY OF THE INVENTION

This invention relates to a crane having a foldable boom.

When a crane is mounted on a motorized carrier or the like, it is desirable to be able to selectively shorten the boom to facilitate travel of the carrier on highways. Such shortening has often been accomplished by forming the boom in two or more connectable sections, with the outer section being foldable.

In some instances, it has been found that when a lengthened outer boom section was folded for travel, its tip portion would engage and undersirably interfere with the operator's cab or other carrier structure. This limited the extent of boom lengthening unless the remaining elements were reconstructed.

The concept of the present invention is based on a solution to the above-mentioned problem and the discovery of a way to fold a lengthened crane boom section in a manner so that it will not engage the carrier structure.

In accordance with the invention, a carrier-mounted crane is provided with inner and outer boom sections which are securable together at upper and lower connections. When the outer boom is to be pivotally folded beneath the inner boom, the lower connection comprises a folding compound arm extending between the boom sections and pivotable intermediate its ends. When the upper boom connection is released and the outer boom folded under, its main pivot connection to the compound arm shifts longitudinally away from the inner boom section, thus effectively moving the outer boom away from the carrier. The tip or outer end of the folded outer boom will thereby remain free of interference with the carrier elements.

BRIEF DESCRIPTION OF THE DRAWINGS

The accompanying drawings illustrate the best mode presently contemplated by the inventor for carrying out the invention.

In the drawings.

DESCRIPTION OF THE PREFERRED EMBODIMENT

Figures 1, 2:
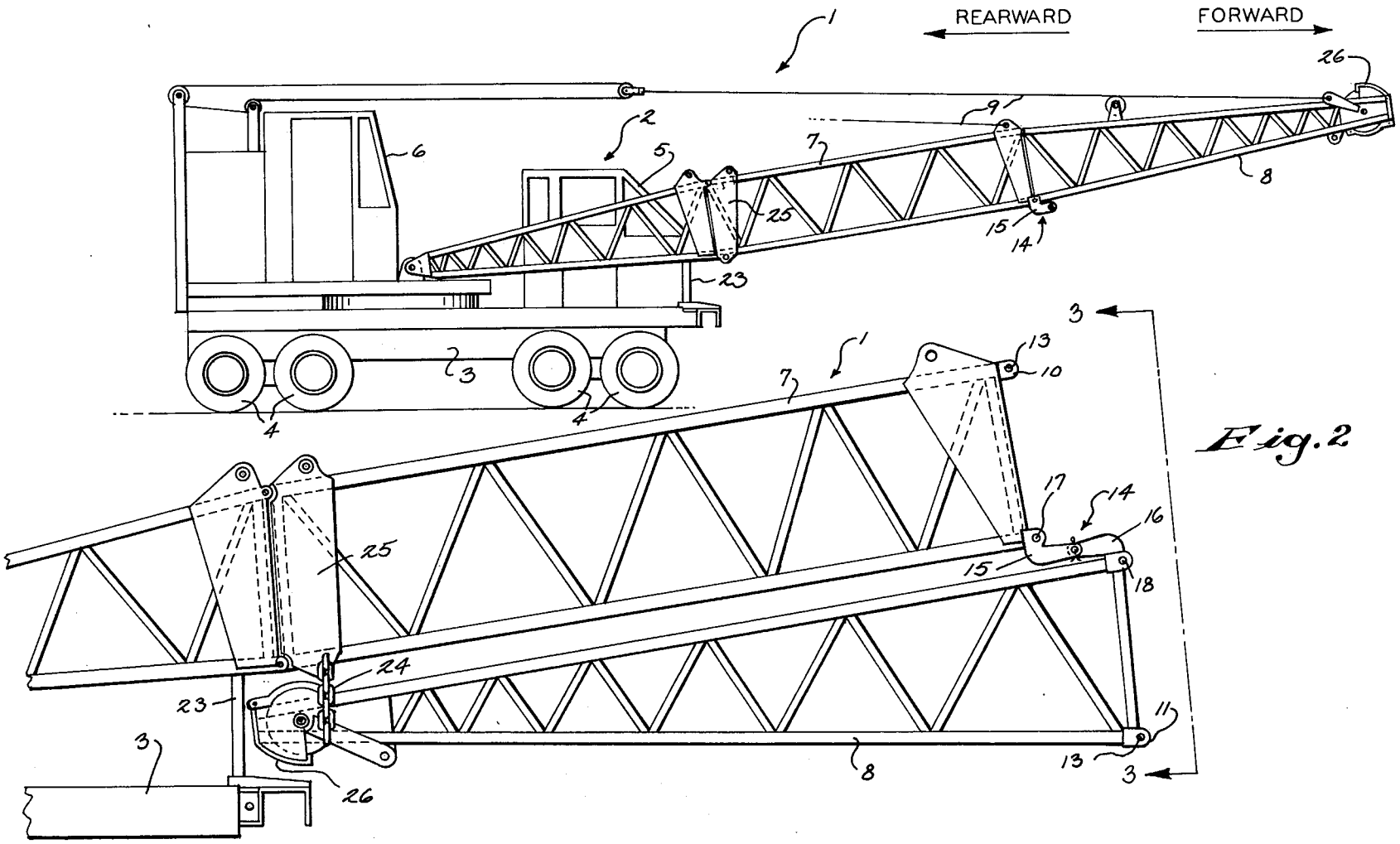
FIG. 1 is a side elevational view of a mobile carrier crane and showing the boom in extended position.
FIG. 2 is an enlarged fragmentary side view similar to FIG. 1 and showing the boom in folded position for travel.

As best shown in FIGS. 1 and 2 of the drawings, the crane 1 is adapted to be mounted on a supporting means such as a mobile carrier 2. The carrier includes a platform 3 supported by wheels 4 and on which is mounted a forwardly positioned driver's cab 5, and a rearwardly positioned crane operator's cab 6. The cabs contain the crane controls and engine, not shown.

Crane 1 includes a plurality of connectable boom sections such as inner section 7 and outer section 8. Inner section 7 is pivotally attached at its rearward end to a forward portion of platform 3 ahead of cab 6, and the entire boom and its working attachments may be operated through cables 9 in the usual well-known manner.

Figure 3:
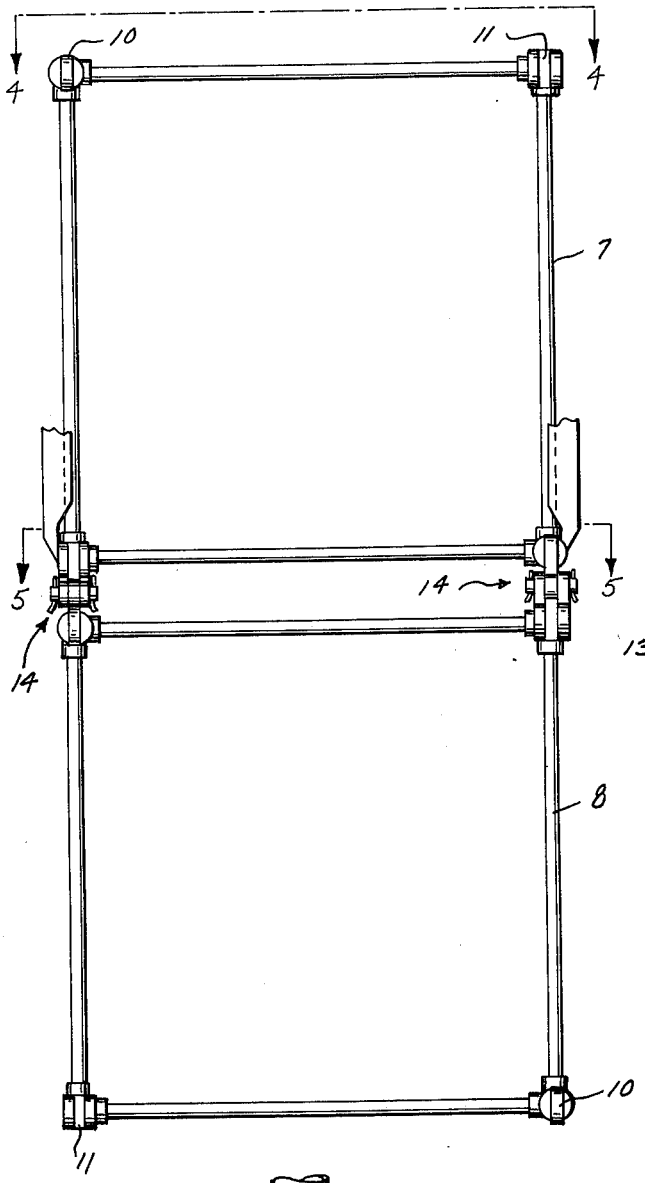
FIG. 3 is an enlarged fragmentary front end elevation of the folded boom, taken on line 3—3 of FIG. 2.
Figure 4:
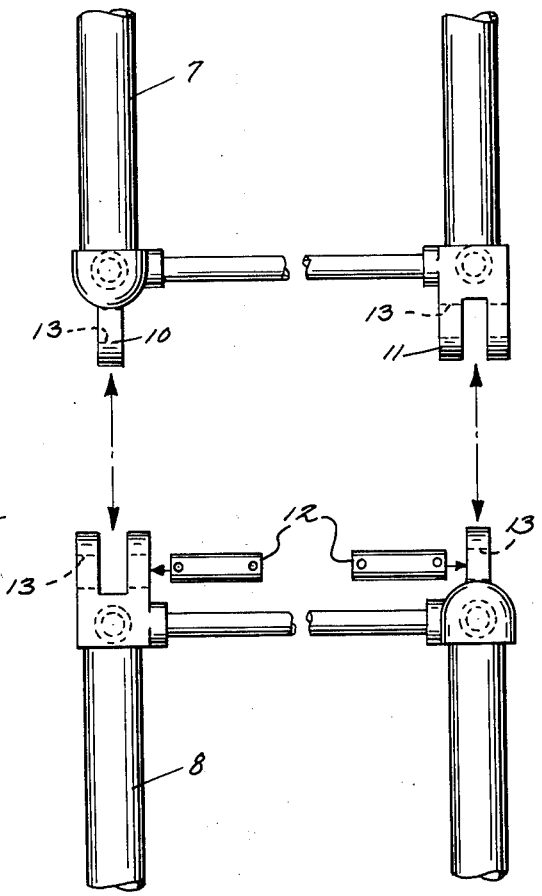
FIG. 4 is a fragmentary top plan view of the inner boom portion taken on line 4—4 of FIG. 3, and with the outer boom portion adjacent for connection therewith or removal therefrom.
Figure 5:
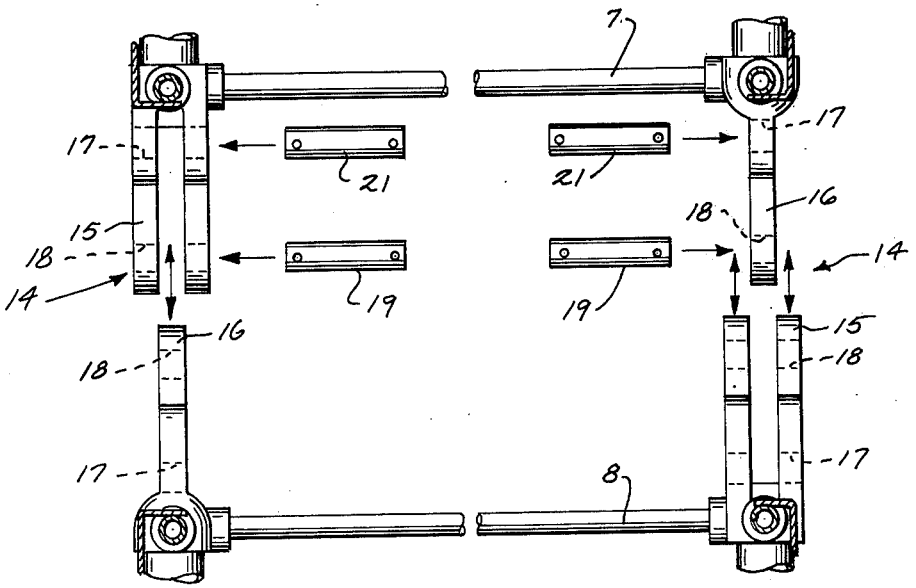
FIG. 5 is a fragmentary horizontal section taken on line 5—5 of FIG. 3, and showing the compound arm structure in separated position.

The boom sections may be of rectangular strut-type design, as shown in FIGS. 1–5. The boom sections are connected as follows. Referring to FIGS. 3 and 4, the upper corners of sections 7 and 8 are provided with complimentary tongue and clevis members, 10 and 11 respectively, and which are adapted to be removably secured together by suitable means such as short shafts 12 which extend through openings 13 and through which cotter pins, not shown, extend. The two tongue-and-clevis connections are shown as reversed, but they need not be for purposes of this invention.

Furthermore, the lower corners of boom sections 7 and 8 are connected by the compound arms 14 of the invention. Reference is made particularly to FIGS. 1, 3, 5 and 6, with the latter figure showing the front side view compound arm only. As shown, each compound arm 14 comprises a bifurcated leg 15 and a tongue-like leg 16 with each leg fixedly secured to the corner of one of the respective boom sections and extending forwardly therefrom when the outer boom is in normal extended position. See FIGS. 1 and 6.

Each leg 15, 16 is provided with spaced inner and outer openings 17 and 18 respectively. The outer openings 18 are remote from openings 17 and are adapted to permanently coincide when the unit is assembled, and a connector shaft 19 and cotter pins 20 hold the legs together, thus providing a central pivot for the arm.

Figure 6:
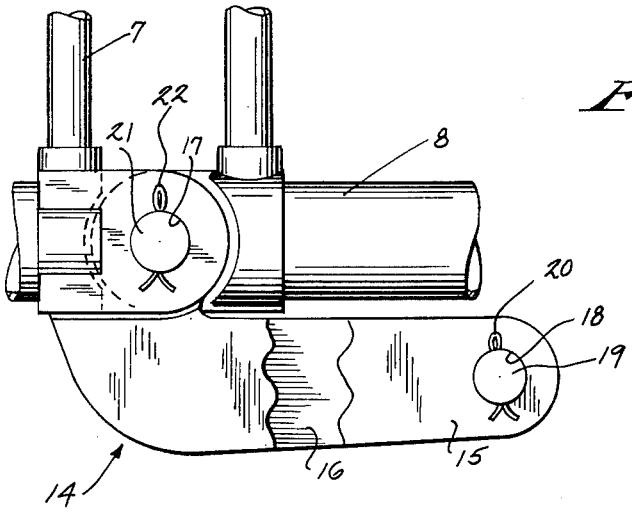
FIG. 6 is an enlarged fragmentary side elevation of the compound arm connection of the extended boom.

When the boom is extended, legs 15 and 16 will be mutually coextensive from end to end and their respective inner openings 17 will become coaxial, as best shown in FIG. 6. During normal working operations, the boom sections will be locked together at their lower corners by shafts 21 which extend through the openings 17 and are held in place by cotter pins 22.

As previously noted, FIG. 6 illustrates the front side view compound arm connection as viewed in FIG. 1. In that instance, bifurcated leg 15 is secured to inner boom section 7 and extends forwardly therefrom, while leg 16 is secured to outer boom section 8 and also extends forwardly.

The leg connections for the two arms 14 are shown as reversed from front to back, but this may not necessarily be required.

With the above-described construction, the open ends of boom sections 7 and 8 are normally held together in closely adjacent face-to-face relationship, and locked together at all four corners.

When it is desired to shorten the boom for travel, the upper corner connections for the boom sections are released, as by removing shafts 12. The lower boom section corners are then unlocked by removing shafts 21. However, the sections remain pivotally connected at shafts 19 and on a fixed transverse axis which is permanently disposed substantially forwardly of the front end or outer terminus of inner boom section 7, which axis is also disposed forwardly of the rear end or inner terminus of outer boom section 8 and slightly beneath said latter section.

Figure 7:
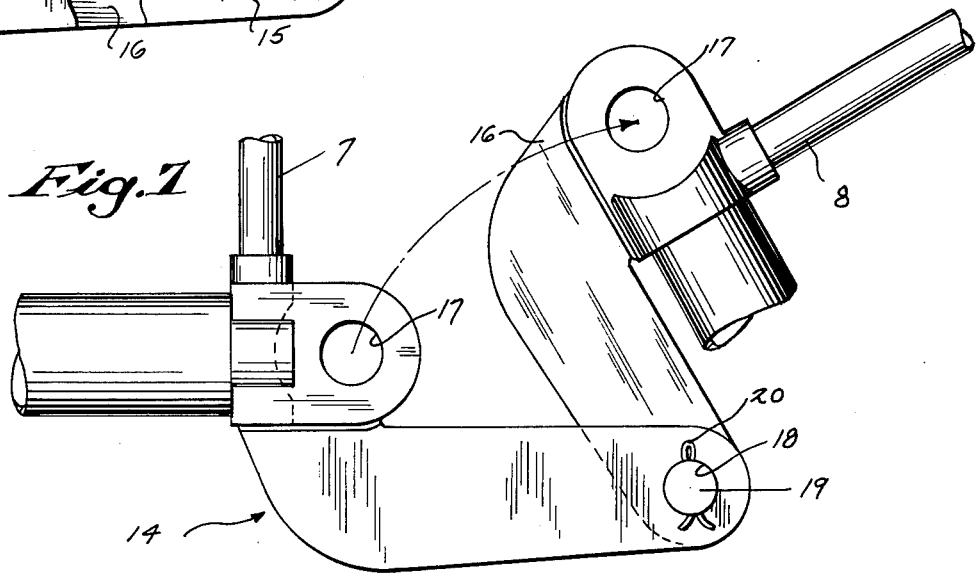
FIG. 7 is a view similar to FIG. 6 and showing the position of the parts when the outer boom is partially folded back.
Figure 8:
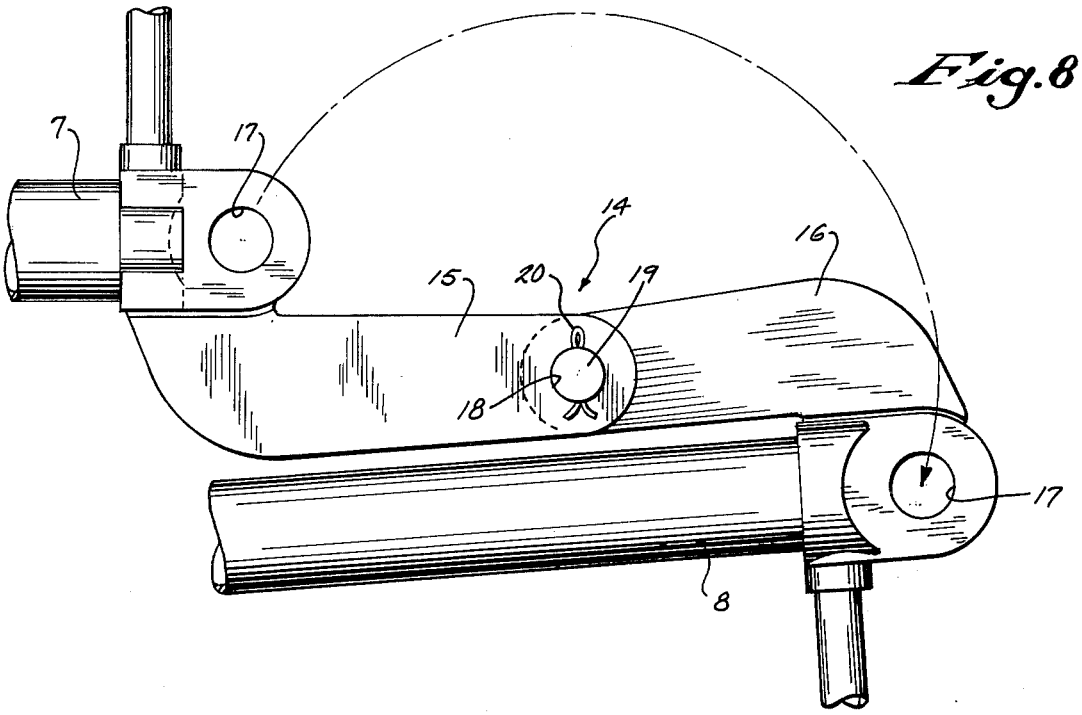
FIG. 8 is a view similar to FIGS. 6 and 7 with the outer boom in fully retracted position.

After the above disconnection, boom section 8 is folded downwardly and rearwardly beneath section 7. FIG. 7 illustrates the folding action in the intermediate position, while FIG. 8 illustrates the final folded position with legs 15 and 16 extending longitudinally separately and non-coextensive. As can be seen by reference to FIGS. 6–8, during retraction, the rearward terminus of boom section 8 moves longitudinally from a normal position closely adjacent section 7 to a folded position substantially spaced forwardly of section 7. The result, as best shown in FIG. 2, is that boom section 8 can be of greater length without interfering with structure such as vertical plate 23 of platform 3, when it is folded.

For purposes of holding boom section 8 in folded position, the tip portion thereof may be cradled in a chain 24 which extends downwardly from a supporting bracket 25 disposed on the intermediate the ends of section 7.

Numerous procedures for folding the boom may be utilized. For example, the entire extended boom may be lowered to the ground and the shafts 12 and 21 then removed. The mobile carrier 2 may then be driven slowly rearwardly which will cause outer boom section 8 to rise to vertical position while a skid 26 on the tip portion thereof rests on the ground. Section 8 may then be pulled rearwardly, as by suitable cables, not shown, and then attached to chain 24.

While the boom illustrated and described herein is shown as foldable beneath itself, a boom could be constructed which folds up and over itself without departing from the spirit of the invention. Furthermore, it may be possible to mount the boom at the rearward portion of platform 3 without departing from the spirit of the invention, and the pertinent language as to front and rear in the specification and claims should be so interpreted.

Various modes of carrying out the invention are contemplated as being within the scope of the following claims particularly pointing out and distinctly claiming the subject matter which is regarded as the invention.

I claim:

1. In a crane mounted at its rearward end on a supporting means:

a. an inner boom section connected through its rearward end to said supporting means, b. an outer boom section normally extending forwardly from said inner section and adapted for folding retraction in a rearward direction relative to the latter, c. and means to shift the inner terminus of said outer boom section to a position which is longitudinally forwardly of its former normal position when said outer section is foldingly retracted, d. said shifting means comprising at least one compound arm extending between said boom sections and forwardly from said inner boom section, said arm being pivotable intermediate its ends about a fixed transverse axis disposed substantially forwardly of said inner section, said axis also being disposed forwardly of the inner terminus of said outer boom section when the latter is in normal extended position, e. the respective ends of said compound arm being fixedly secured to said boom sections, f. said compound arm comprising a pair of legs joined at an intermediate arm pivot, g. each of said pair of legs being coextensive with the other leg when said outer boom section is extended, and being non-coextensive with said other leg when said outer boom section is in folded retracted position.

2. The crane of claim 1 which includes means remote from the said intermediate arm pivot for selectively locking said boom sections in place when said outer boom section is extended, or for unlocking said sections to permit said outer section to be foldingly retracted.

3. In a crane mounted at its rearward end on a supporting means:

a. an inner boom section connected through its rearward end to said supporting means, b. an outer boom section normally extending forwardly from said inner section and adapted for folding retraction in a rearwardly direction relative to the latter, c. means to shift the inner terminus of said outer boom section to a position which is longitudinally forwardly of its former normal position when said outer section is foldingly retracted, d. said shiftng means comprising at least one compound arm extending between said boom sections and forwardly from said inner boom section, said arm being pivotable intermediate its ends about a fixed transverse axis disposed substantially forwardly of said inner section, said axis also being disposed forwardly of the inner terminus of said outer boom section when the latter is in normal extended position, e. the respective ends of said compound arm being fixedly secured to said boom section, f. said compound arm comprising a pair of legs joined at an intermediate arm pivot, g. each of said pair of legs being provided with an opening remote from the intermediate arm pivot, h. said legs being co-extensive and with the said openings being disposed co-axially when said outer boom section is extended, i. and removable means extending through said coaxial openings for selectively locking said boom sections in place or unlocking said sections to permit said folding retractions.

4. The crane of claim 3 which includes means to hold said outer boom section in folded retracted position.

5. The crane of claim 4 wherein said holding means comprises:

a. a supporting bracket disposed on said inner boom section and intermediate its ends, b. and chain means extending between said bracket and said outer boom section.

6. The crane of claim 5 which includes skid means disposed on the outer tip portion of said outer boom section to permit said tip portion to move along the ground during retraction of said outer portion.

7. In a crane mounted at its rearward end on a supporting means:

a. an inner boom section connected through its rearward end to said supporting means, b. an outer boom section normally extending forwardly from said inner section and adapted for folding retraction in a rearward direction relative to the latter, c. and means to shift the inner terminus of said outer boom section to a position which is longitudinally forwardly of its former normal position when said outer section is foldingly retracted, d. said shifting means comprising at least one compound arm extending between said boom sections and forwardly from said inner boom section, e. said arm comprising a pair of pivotally connected legs connected at a pivot point which lies outwardly and forwardly of said inner boom section, said legs being mutually coextensive from end to end when said outer boom section is extended.

* * * * *